United States Patent [19]

Beswick et al.

[11] 4,189,696

[45] Feb. 19, 1980

[54] ELECTRIC FUSE-LINKS AND METHOD OF MAKING THEM

[75] Inventors: David G. E. Beswick, Corsley; Stanley Wright, Frome, both of England

[73] Assignee: Kenneth E. Beswick Limited, Frome, England

[21] Appl. No.: 859,566

[22] Filed: Dec. 12, 1977

Related U.S. Application Data

[63] Continuation of Ser. No. 686,873, May 17, 1976, abandoned.

[30] Foreign Application Priority Data

May 22, 1975 [GB] United Kingdom ..... 22422/75

[51] Int. Cl.[2] ..... H01H 85/04

[52] U.S. Cl. ..... 337/232; 337/292

[58] Field of Search ..... 337/159, 163, 232, 290, 337/291, 292, 293, 294, 295, 296, 297

[56] References Cited

U.S. PATENT DOCUMENTS

| | | | |
|---|---|---|---|
| 898,086 | 9/1908 | Boehm | 337/294 X |
| 3,845,439 | 10/1974 | Deelman | 337/295 X |
| 3,858,142 | 12/1974 | Deelman et al. | 337/296 X |

*Primary Examiner*—George Harris

*Attorney, Agent, or Firm*—Brisebois & Kruger

[57] ABSTRACT

A fuse element for a cartridge fuse-link comprises a thin metal wire helically wound about a thin flexible core consisting of an electrically and heat insulating filament. Spaced sections of the winding at opposite ends of the fuse element are metallized so as to short-circuit the turns in these sections. The short-circuited sections are electrically interconnected by the active turns of an intermediate section which constitutes the fusible link. The fuse element is disposed in an insulating cartridge with its short-circuited sections connected to conductive end caps on the cartridge.

9 Claims, 2 Drawing Figures

ELECTRIC FUSE-LINKS AND METHOD OF MAKING THEM

This is a continuation of application Ser. No. 686,873, filed May 17, 1976 now abandoned.

BACKGROUND OF THE INVENTION

The present invention relates to electrical fuse-links for protecting electrical and electronic equipment.

British Pat. No. 1,304,629 in the name of Olvis Smeltzekeringen, Fabrick, N.V. and dated May 10, 1971 describes a fuse element consisting of a very thin or fine wire helically wound about a rigidified insulating core. The latter serves to support the wire and prevent sagging thereof and also provides handling strength for the fuse element. The core should be heat-resistive and be a good heat insulator and not maintain combustion, as well as being an electrical insulator and should be thin so that its heat dissipation can be substantially neglected. A thin rigidified core made from a fibre or filament of glass-fibre material has the required properties and its manageability allows the core to be sufficiently thin for its heat dissipation to be substantially neglected. The thin wire is wound onto the thin rigidified core in a multiplicity of closely spaced turns.

One disadvantage which has been experienced with the type of fuse element comprising a thin core supporting the windings of a thin fuse wire, is the relatively high resistance which results from the large number of turns of the wire wound on the core and an object of the present invention is to reduce or overcome this disadvantage.

SUMMARY OF THE INVENTION

From one aspect, the present invention consists in a fuse element comprising a thin metal wire helically wound with a multiplicity of turns about a thin flexible core consisting of an electrically insulating and heat insulating fibre or filament, the turns of the winding in spaced longitudinal sections of the latter disposed at opposite ends of the fuse element being short-circuited. The short-circuited sections of the fuse element are electrically interconnected by the active turns of an intermediate section of the winding and it is only these active turns, which may be relatively few in number, which constitute the fusible link.

The fuse element according to the invention is particularly suitable for making time-lag fuse-links intended to rupture at low current values, for example, below 7 amps. The thin flexible core is conveniently made from a fibre or filament of glass-fibre material and its diameter is preferably not greater than 0.030 inches. The thin metal wire preferably has a well-defined melting point and a diameter not greater than 0.015.

The fuse element may be secured between electrically conductive terminals at opposite ends of a cartridge or container with its short-circuited sections connected to the terminals, the intermediate section consisting of the active turns of the winding being disposed approximately midway between the terminals in the centre of the cartridge.

From another aspect, the invention consists in a method of manufacturing an electrical fuse-link, comprising the steps of helically winding a thin metal wire in a multiplicity of turns about a thin flexible core consisting of an electrically insulating and heat insulating fibre or filament, short-circuiting the turns of two spaced longitudinal sections of the winding, and mounting the fuse element thus formed in a cartridge or other container with the short-circuited sections in electrical contact with terminals thereof. The wound core may be produced by a continuous process and be subsequently cut into predetermined lengths. The turns of longitudinal sections of the winding at and adjacent opposite ends of each cut length are then short-circuited to produce a fuse element.

From a further aspect, the invention consists in a method of manufacturing an electrical fuse element, comprising the steps of helically winding a thin metal wire in a multiplicity of turns about a thin flexible core consisting of an electrically insulating and heat insulating fibre or filament, short-circuiting the turns in consecutive longitudinal sections spaced apart along the winding, cutting the wound core at positions intermediate the ends of said consecutive longitudinal sections so as to produce a fuse element having short-circuited turns in sections of the winding at opposite ends of the fuse element electrically interconnected by an intermediate section of active turns, and mounting the fuse element in a cartridge or other container.

The turns of the winding may be short-circuited in a number of different ways. In a preferred form of the invention, the spaced longitudinal sections of the winding are metallised with a solder coating after the winding step. However, the sections may be short-circuited by any other suitable means.

The short-circuited sections of the fuse element result in a considerable reduction in the electrical resistance of a fuse-link incorporating such a fuse element. The short-circuited sections also serve to stiffen the fuse element and make it more manageable.

Whilst the thin metal wire is conveniently wound onto the flexible core in a multiplicity of closely spaced turns, it is also possible to provide the wire with an insulating coating and to wind it on the core so that its turns are in contiguous relation. The present invention is equally applicable to such a construction, the insulating coating on the wire readily being destroyed in those sections of the winding which are to be short-circuited by the application of heat upon metallisation of the sections, or any other means. An insulated wire is particularly advantageous for producing very low current fuses, for example, less than 250 mA. The very fine fuse wires used at such values tend to dissolve in the solder upon metallisation and an insulating coating reduces or avoids this tendancy.

BRIEF DESCRIPTION OF THE DRAWINGS

In order that the invention may be more readily understood, reference will now be made to the accompanying drawings, in which.

DESCRIPTION OF PREFERRED EMBODIMENTS

Figure 1:
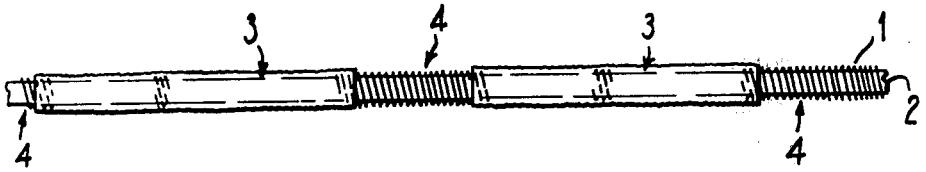
FIG. 1 illustrates, on an enlarged scale, a piece of fuse element material made in accordance with the invention.

Referring to FIG. 1 of the drawings, the fuse element material is produced by winding a thin metal wire 1 having a well-defined melting point, for example a copper or silver wire, about a thin flexible fibrous filament 2, for example, a glass-fibre thread. The wire is wound on the core in a multiplicity of closely spaced turns.

Consecutive longitudinal sections or regions 3 of the winding spaced at intervals along the core are then metallised with a solder coating so as to short-circuit the turns in those sections. The short-circuited sections 3 are electrically interconnected by intermediate sections 4 having unshort-circuited or active turns. The fuse element material may be readily manufactured by an automated process.

The ratio of metallised to unmetallised sections, the winding pitch, wire material and diameter and core diameter can all be varied to obtain different current ratings and blowing or melting characteristics for the fuse elements to be formed from the fuse material.

Figure 2:
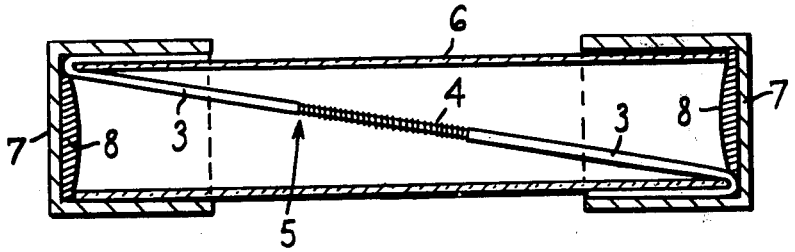
FIG. 2 is an axial section through a cartridge fuse-link embodying the invention.

The fuse element material is formed into individual fuse elements by cutting the material at positions intermediate the ends of consecutive metallised sections 3 so as to produce a fuse element having metallised sections at opposite ends thereof interconnected by the active turns of an intermediate section 4. The fuse element thus produced may be mounted in a cartridge or container of non-conductive material and be electrically connected to end terminations which serve as electrical terminals for connecting the fuse-link in an electrical circuit. One such cartridge fuse-link is illustrated in FIG. 2. It comprises a glass tube 6, or a tube made from another insulating material, having metal end caps 7 which serve as electrical terminals for connecting the fuse-link in an electrical circuit. The fuse element 5 is mounted in the tube by gripping the metallised sections 3 of the element between the end caps and the tube at opposite ends of the latter. A sealing material 8 is provided on the inside of each end cap between the adjacent end of the tube and the end wall of the cap.

In the resulting fuse-link, only the relatively few turns of the winding in the intermediate section 4 perform the function of active fusing and the fuse-link has considerably less electrical resistance than hitherto known fuse-links having a fuse element formed from fine metal wire wound on a flexible insulating core. Moreover, the metallised sections at each end of the fuse element serve to stiffen the element and make it more manageable during assembly of the fuse-link.

Whilst particular embodiments have been described, it will be understood that various modifications can be made without departing from the scope of the invention as defined by the appended claims. For example, in an alternative embodiment to that shown in FIG. 2, the metallised ends of the fuse element 5 may be soldered to the central portions of the end caps 7 instead of being gripped between the caps and the adjacent portions of the tube 6.

We claim:

1. A fuse element comprising:
(a) a thin flexible electrically insulating and heat insulating filament core,
(b) a fuse winding comprising a thin metal fuse wire helically wound with a multiplicity of turns about said core,
(c) said winding including spaced longitudinal sections disposed respectively at opposite ends of said core and spaced apart by an intermediate section of said winding,
(d) each of said spaced sections including multiple turns of said winding, and
(e) means short circuiting the said multiple turns of each of said spaced sections,
(f) said short circuited turns of said spaced sections being electrically interconnected by the active turns of said intermediate section of said winding.

2. A fuse element as claimed in claim 1, wherein said short-circuiting means comprises solder coatings on said spaced longitudinal sections of the winding.

3. A fuse element as claimed in claim 1, wherein said fuse wire has an insulating coating and is helically wound onto the core with its turns in contiguous relation.

4. A fuse element as claimed in claim 1, wherein the diameter of said fuse wire is not greater than 0.015 inches and the diameter of the said core is not greater than 0.030 inches.

5. A fuse element as claimed in claim 1, wherein
(a) said thin metal fuse wire has a well-defined melting point,
(b) said flexible core consists of a thread of twisted glass fibres,
(c) said wire has an insulating coating,
(d) and said short-circuiting means consists of solder coatings over said longitudinal sections at opposite ends of said core, whereby said insulating coating is destroyed in said sections which are short-circuited by said solder coatings.

6. a cartridge fuse-link including a fuse element as claimed in claim 1, comprising:
(a) a tubular insulating cartridge,
(b) electrically conductive end caps secured to opposite ends of said cartridge,
(c) said fuse-element being secured between said end caps with its short-circuited longitudinal sections in electrical contact with said caps.

7. A method of manufacturing a cartridge fuse-link comprising the steps of:
(a) helically winding a thin metal fuse wire with a multiplicity of turns about a thin flexible core consisting of an electrically insulating and heat insulating filament,
(b) short-circuiting the turns of two spaced longitudinal sections of the winding, and
(c) mounting the fuse element thus formed in a tubular insulating cartridge with said short-circuited longitudinal sections in electrical contact with electrically conductive terminals secured to opposite ends of said cartridge.

8. A method as claimed in claim 7, including the steps of:
(a) continuously winding said fuse wire about a continuous filament,
(b) cutting the wound filament into predetermined lengths, and
(c) short-circuiting the turns in spaced longitudinal sections of the winding at and adjacent opposite ends of a cut length so as to form said fuse element.

9. A method as claimed in claim 7, including the steps of:
(a) continuously winding said fuse wire about a continuous filament,
(b) short-circuiting the turns in a plurality of longitudinal sections of the winding spaced apart along said filament, and
(c) cutting the wound filament at positions intermediate the ends of consecutive short-circuited longitudinal sections so as to form said fuse element.

* * * * *